US011076703B2

(12) United States Patent
Choi

(10) Patent No.: US 11,076,703 B2
(45) Date of Patent: Aug. 3, 2021

(54) COLLAPSIBLE PERIPHERAL FRAME AND BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 90 days.

(21) Appl. No.: 16/506,525

(22) Filed: Jul. 9, 2019

(65) Prior Publication Data

US 2020/0022502 A1 Jan. 23, 2020

(30) Foreign Application Priority Data

Jul. 17, 2018 (CN) ..... 201810785187.9

(51) Int. Cl.
*A47C 19/12* (2006.01)
*A47C 19/02* (2006.01)
*A47C 19/00* (2006.01)

(52) U.S. Cl.
CPC ..... *A47C 19/126* (2013.01); *A47C 19/027* (2013.01); *A47C 19/005* (2013.01); *A47C 19/025* (2013.01); *A47C 19/12* (2013.01)

(58) Field of Classification Search
CPC ..... A47C 19/12; A47C 19/122; A47C 19/124; A47C 19/126; A47C 19/005; A47C 19/02; A47C 19/021; A47C 19/025; A47C 19/027; A47C 19/04
USPC ..... 5/200.1, 201, 202, 282.1, 283, 285, 286, 5/174, 177
See application file for complete search history.

(56) References Cited

U.S. PATENT DOCUMENTS 273,332 A * 3/1883 Woodin ..... A47C 23/062 5/238
277,541 A * 5/1883 Bowers ..... A47C 23/062 5/238
372,913 A * 11/1887 Hopkins ..... A47C 23/062 5/238
557,997 A * 4/1896 Nessel ..... A47C 23/062 5/238
687,238 A * 11/1901 Johnson ..... A47C 23/062 5/238
705,384 A * 7/1902 Cooper ..... A47C 23/062 5/238

(Continued)

FOREIGN PATENT DOCUMENTS

DE 102018130110 A1 5/2020

*Primary Examiner* — Robert G Santos
(74) *Attorney, Agent, or Firm* — Morgan, Lewis & Bockius LLP

(57) ABSTRACT

A collapsible peripheral frame includes first and second outer lateral bar units, and first and second longitudinal bar assemblies. Each of first and second longitudinal bar assemblies comprises first, second and third longitudinal bar units rotatably connected with each other at their adjacent ends. The first outer lateral bar unit has a first end connected with an end of the first longitudinal bar unit in the first longitudinal bar assembly and a second end rotatably connected with an end of the third longitudinal bar unit in the second longitudinal bar assembly. The second outer lateral bar unit has a first end rotatably connected with an end of the third longitudinal bar unit in the first longitudinal bar assembly and a second end connected with an end of the first longitudinal bar unit in the second longitudinal bar assembly.

20 Claims, 5 Drawing Sheets

(56) References Cited

U.S. PATENT DOCUMENTS 736,569 A * 8/1903 Webb ..... A47C 23/062 5/238
746,211 A * 12/1903 Webb ..... A47C 23/062 5/238
797,011 A * 8/1905 Mosier ..... A47C 23/062 5/238
984,823 A * 2/1911 Linden ..... A47C 19/022 5/279.1
1,694,420 A 12/1928 Joselowitz
1,833,692 A * 11/1931 Silvio ..... F16B 9/052 5/238
2,057,334 A * 10/1936 Hannum ..... A47B 3/002 108/157.17
2,492,070 A * 12/1949 Stone et al. ..... A47C 19/025 5/238
2,680,252 A * 6/1954 Hatton ..... A47D 13/065 5/99.1
2,772,424 A 12/1956 Roche
2,983,931 A * 5/1961 Nelson ..... F16B 12/54 5/238
3,605,142 A * 9/1971 Weinhart ..... A47C 23/067 5/238
3,613,132 A * 10/1971 Weinhart ..... A47C 23/062 5/268
3,657,748 A * 4/1972 Weinhart ..... A47C 23/062 5/238
3,984,884 A * 10/1976 Spitz ..... A47C 19/005 5/176.1
4,745,644 A * 5/1988 Pottschmidt ..... A47C 19/005 5/200.1
4,788,727 A 12/1988 Liu
5,469,589 A * 11/1995 Steed ..... A47C 19/005 5/201
7,003,822 B1 * 2/2006 Sheehy ..... A47C 19/005 5/200.1
7,376,986 B2 5/2008 Smith
7,739,760 B2 * 6/2010 Wang ..... A47C 27/082 5/176.1
7,784,122 B2 * 8/2010 Oh ..... A47C 19/005 5/201
7,845,030 B1 12/2010 Pollard
8,006,328 B2 8/2011 Polevoy
8,006,329 B2 * 8/2011 Oh ..... A47C 19/005 5/201
8,042,205 B2 * 10/2011 Schulz, Jr. ..... A47C 19/005 5/200.1
8,176,581 B2 * 5/2012 Schulz, Jr. ..... A47C 19/005 5/200.1
8,832,876 B1 9/2014 Oh
8,935,819 B1 * 1/2015 Hartley ..... A47C 19/005 5/400
8,978,176 B1 3/2015 Oh
8,990,979 B1 3/2015 Craver
9,596,943 B1 * 3/2017 Hartley ..... A47C 19/025
9,924,804 B2 * 3/2018 Hartley ..... A47C 19/005
10,687,630 B1 * 6/2020 Hartley ..... A47C 19/025
10,702,070 B2 * 7/2020 Oh ..... A47C 19/027
10,959,529 B2 * 3/2021 Choi ..... A47C 19/025
10,959,530 B2 * 3/2021 Choi ..... A47C 19/027
2006/0107456 A1 * 5/2006 Joseph ..... A47C 17/58 5/2.1
2008/0109958 A1 * 5/2008 Wang ..... A47C 27/083 5/279.1
2009/0025143 A1 * 1/2009 Oh ..... A47C 19/005 5/201
2010/0170190 A1 * 7/2010 Schulz, Jr. ..... A47C 19/021 52/745.19
2010/0235989 A1 9/2010 Jin
2010/0275372 A1 * 11/2010 Oh ..... A47C 19/005 5/201
2011/0258777 A1 * 10/2011 Schulz, Jr. ..... A47C 19/025 5/286
2013/0000038 A1 1/2013 Schulz, Jr.
2013/0025051 A1 1/2013 Syrowitz
2014/0208506 A1 7/2014 Bartelsmeyer
2016/0143446 A1 5/2016 Hartley
2016/0255963 A1 * 9/2016 Jones ..... A47C 19/025
2018/0042391 A1 * 2/2018 Oh ..... A47C 19/027
2018/0055235 A1 * 3/2018 Choi ..... A47C 19/12
2018/0116412 A1 5/2018 Jin
2019/0387888 A1 * 12/2019 Choi ..... A47C 19/122
2019/0387889 A1 * 12/2019 Choi ..... A47C 19/025
2019/0387890 A1 * 12/2019 Choi ..... A47C 19/126
2019/0387891 A1 * 12/2019 Choi ..... A47C 19/022
2019/0387892 A1 * 12/2019 Choi ..... A47C 19/126
2019/0387893 A1 * 12/2019 Choi ..... F16B 12/56
2020/0022501 A1 * 1/2020 Choi ..... A47C 19/12
2020/0022502 A1 * 1/2020 Choi ..... A47C 19/027
2020/0022503 A1 * 1/2020 Choi ..... A47C 19/12
2020/0146438 A1 * 5/2020 Choi ..... A47B 13/003
2020/0378426 A1 * 12/2020 Choi ..... A47C 19/025

* cited by examiner

COLLAPSIBLE PERIPHERAL FRAME AND BED FRAME HAVING SAME

CROSS-REFERENCE TO RELATED APPLICATIONS

The present application claims priority to Chinese Utility Model Application CN 201810785187.9, filed Jul. 17, 2018. The disclosure of the application is incorporated herein for all purposes by reference in its entirety.

FIELD OF THE INVENTION

The present invention generally relates to bed frames, and more particularly, to collapsible peripheral frames and bed frames having collapsible peripheral frames.

BACKGROUND

Beds are usually the main furniture in bedrooms and often occupy the majority of the space. In modern days, foldable beds become daily necessities in particular when the space is limited. Foldable beds are desirable because they are convenient to use and require less space for storage. However, many components of existing foldable bed frames are usually connected by bolts or the like. Some of these components have to be disassembled to allow the folding of the frames. Separated components may be displaced or got lost. Moreover, to use the frames again, separated components have to be re-assembled or installed, which may be time-consuming. In addition, separated components are sometimes difficult to handle during shipping, transportation or storage.

Given the current state of the art, there remains a need for collapsible beds and bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides collapsible peripheral frames and bed frames having collapsible peripheral frames.

In various exemplary embodiments, the present invention provides a bed frame including a first outer lateral bar unit and a second outer lateral bar unit, and further including first, second and third longitudinal bar units disposed at each of first and second sides of the bed frame between the first and second outer lateral bar units. The first outer lateral bar unit is disposed at a head side of the bed frame. The second outer lateral bar unit is disposed at a foot side of the bed frame. At the first side of the bed frame: a first end of the first longitudinal bar unit is connected with a first end of the first outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with a first end of the second outer lateral bar unit. At the second side of the bed frame: a first end of the first longitudinal bar unit is connected with a second end of the second outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with a second end of the first outer lateral bar unit.

In some exemplary embodiments, the length of the combination of the first and second longitudinal bar units is greater than that of the third longitudinal bar unit.

In some exemplary embodiments, the first longitudinal bar unit has a length that is equal to or greater than a combined thickness of the second and third longitudinal bar units.

In some exemplary embodiments, at each of the first and second sides of the bed frame, the second and third longitudinal bar units are rotatably connected with each other through a connecting piece, wherein the second end of the second longitudinal bar unit and the first end of the third longitudinal bar unit are rotatably connected with the connecting piece.

In some exemplary embodiments, at each of the first and second sides of the bed frame, a receptacle is disposed at the second longitudinal bar unit adjacent the second end thereof and is configured to removably receive an end of an inner lateral bar.

In various exemplary embodiments, the present invention provides a collapsible peripheral frame including first and second outer lateral bar units, and first and second longitudinal bar assemblies. Each of the first and second outer lateral bar units includes a first end and a second end. The first longitudinal bar assembly is disposed at a first side of the bed frame and connected with the first ends of the first and second outer lateral bar units. The second longitudinal bar assembly is disposed at a second side of the bed frame and connected with the second ends of the first and second outer lateral bar units. Each of the first and second longitudinal bar assemblies includes first, second and third longitudinal bar units. Of the first longitudinal bar assembly: a first end of the first longitudinal bar unit is connected with the first end of the first outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with the first end of the second outer lateral bar unit. Of the second longitudinal bar assembly: a first end of the first longitudinal bar unit is connected with the second end of the second outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with the second end of the first outer lateral bar unit.

In some exemplary embodiments, of the first longitudinal bar assembly, the first end of the first longitudinal bar unit is fixedly connected with the first end of the first outer lateral bar unit; and of the second longitudinal bar assembly, the first end of the first longitudinal bar unit is fixedly connected with the second end of the second outer lateral bar unit.

In some exemplary embodiments, of the first longitudinal bar assembly, the first longitudinal bar unit is disposed substantially perpendicular to the first outer lateral bar unit; and of the second longitudinal bar assembly, the first longitudinal bar unit is disposed substantially perpendicular to the second outer lateral bar unit.

In some exemplary embodiments, the length of the combination of the first and second longitudinal bar units is greater than that of the third longitudinal bar unit.

In an exemplary embodiment, the second longitudinal bar unit has a length that is substantially the same as the third longitudinal bar unit.

In an exemplary embodiment, the first longitudinal bar unit has a length that is equal to or greater than a combined thickness of the second and third longitudinal bar units.

In some exemplary embodiments, at each of the first and second sides of the bed frame, the second and third longitudinal bar units are rotatably connected with each other through a connecting piece, wherein the second end of the second longitudinal bar unit and the first end of the third longitudinal bar unit are rotatably connected with the connecting piece.

In some exemplary embodiments, at each of the first and second sides of the bed frame, a receptacle is disposed at the second longitudinal bar unit adjacent the second end thereof and is configured to removably receive an end of an inner lateral bar.

In various exemplary embodiments, the present invention provides a bed frame including a collapsible peripheral frame disclosed herein.

In some exemplary embodiments, the bed frame further includes an inner lateral bar, wherein at each of the first and second sides of the bed frame, a receptacle is disposed at the second longitudinal bar unit of the collapsible peripheral frame adjacent the second end of the second longitudinal bar unit. The receptacle is configured to removably receive an end of the inner lateral bar.

The collapsible peripheral frames and bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
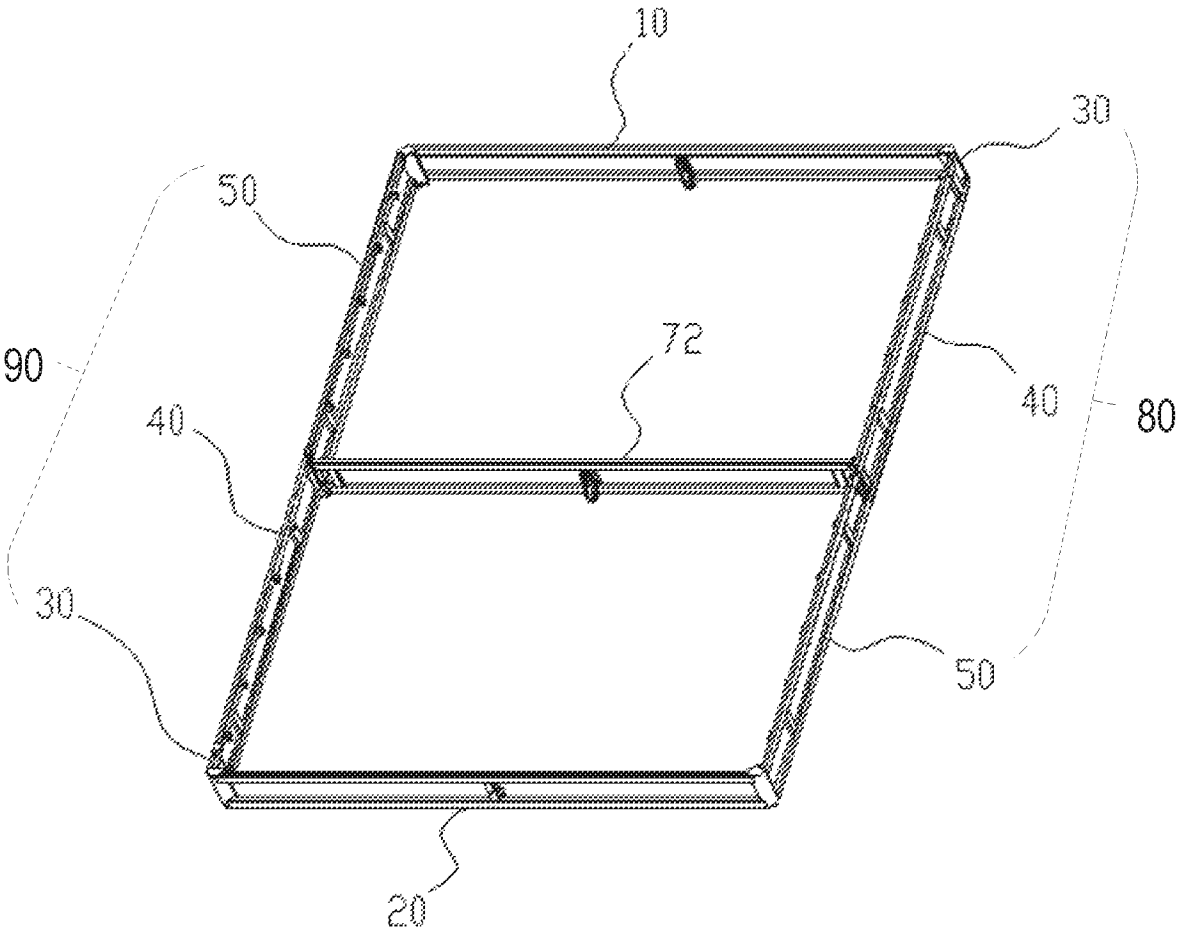
FIG. 1 is a perspective view illustrating an exemplary bed frame in an expanded state in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of collapsible peripheral frames and bed frames having such collapsible peripheral frames. The collapsible peripheral frames and bed frames of the present invention can be of various sizes including but not limited to twin, full, queen and king sizes, and of various shapes including but not limited to rectangles and squares. They can be made of various materials including but not limited to metals (e.g., cast iron, steel, and aluminum), plastics and woods.

In general, a collapsible peripheral frame of the present invention includes first and second outer lateral bar units. The collapsible peripheral frame also includes a first longitudinal bar assembly disposed at a first side of the bed frame and connected with the first ends of the first and second outer lateral bar units, and a second longitudinal bar assembly disposed at a second side of the bed frame and connected with the second ends of the first and second outer lateral bar units. Each of the first and second longitudinal bar assemblies includes a plurality of longitudinal bar units connected with each other at adjacent ends.

In some exemplary embodiments, first and second outer lateral bar units are disposed substantially parallel to each other.

In some exemplary embodiments, each of the first and second longitudinal bar assemblies includes first, second and third longitudinal bar units. Of the first longitudinal bar assembly, a first end of the first longitudinal bar unit is connected with the first end of the first outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with the first end of the second outer lateral bar unit. Of the second longitudinal bar assembly, a first end of the first longitudinal bar unit is connected with the second end of the second outer lateral bar unit; a second end of the first longitudinal bar unit is rotatably connected with a first end of the second longitudinal bar unit; a second end of the second longitudinal bar unit is rotatably connected with a first end of the third longitudinal bar unit; and a second end of the third longitudinal bar unit is rotatably connected with the second end of the first outer lateral bar unit.

Figure 2:
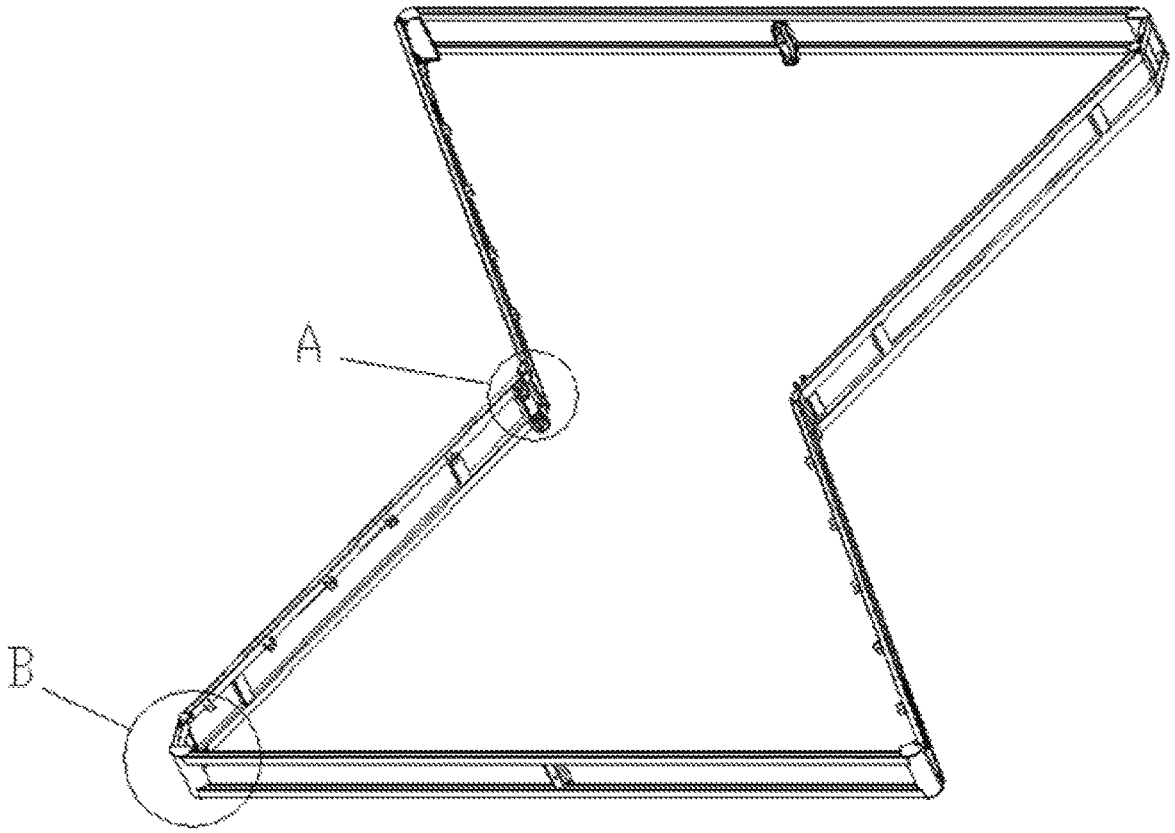
FIG. 2 is a perspective view illustrating an exemplary peripheral frame in an intermediate state in accordance with exemplary embodiments of the present invention.
Figure 5:
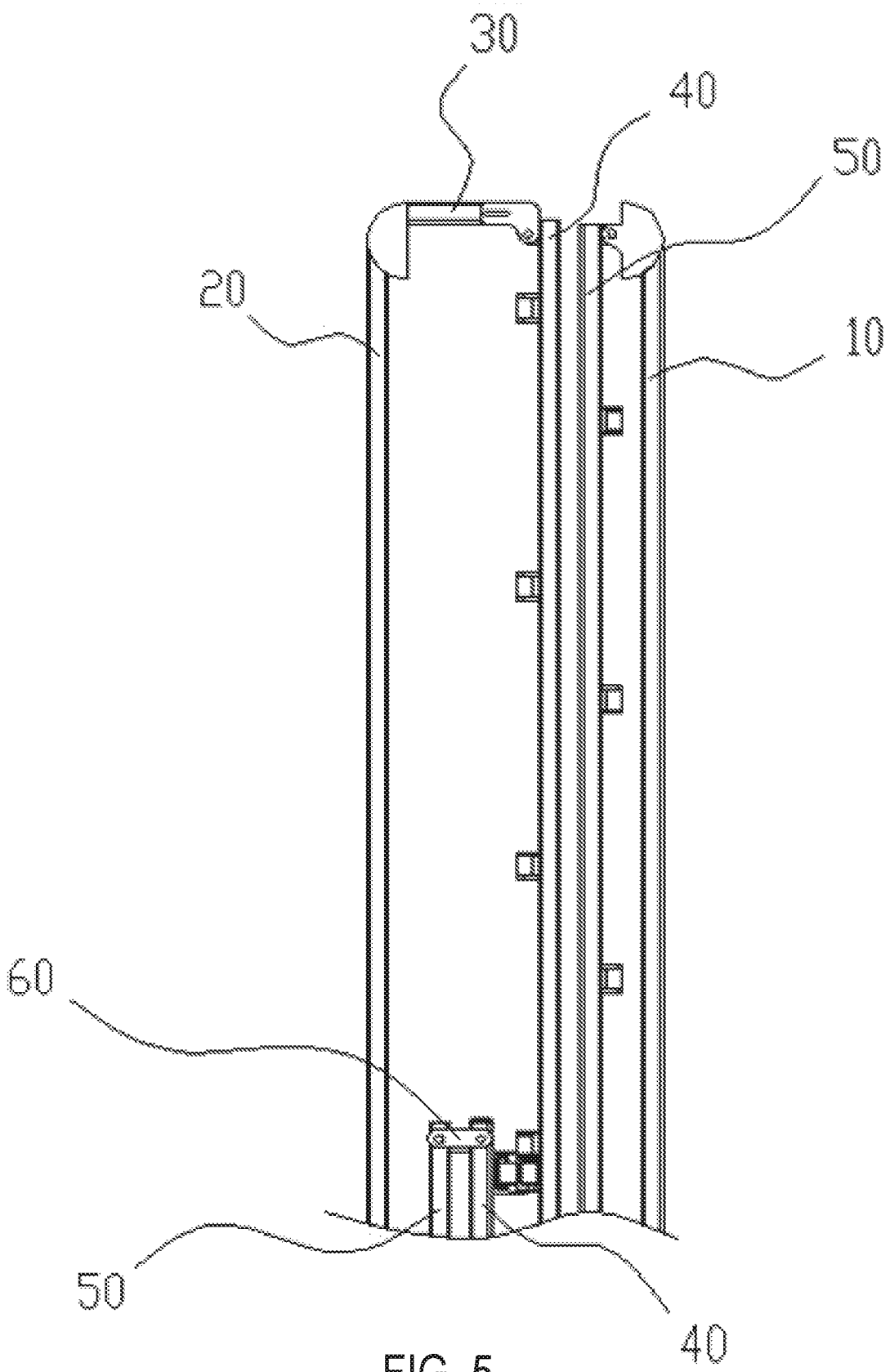
FIG. 5 is a top view illustrating a portion of an exemplary peripheral frame in a collapsed state in accordance with exemplary embodiments of the present invention.

For instance, by way of example, FIGS. 1, 2 and 5 illustrate a collapsible peripheral frame including first outer lateral bar unit 10 and second outer lateral bar unit 20. The first and second outer lateral bar units are disposed substantially parallel to each other. In some exemplary embodiments, the first and second outer lateral bar units are disposed at two sides of the bed frame corresponding to head and foot sides of the bed frame. The other two sides are referred to as a first side (e.g., the right side in FIG. 1) and a second side (e.g., the left side in FIG. 1). Each of the first and second outer lateral bar unit includes a first end at the first side of the bed frame and a second end at the second side of the bed frame.

The collapsible peripheral frame also includes first longitudinal bar assembly 80 and second longitudinal bar assembly 90. Each of the first and second longitudinal bar assemblies includes first longitudinal bar unit 30, second longitudinal bar unit 40 and third longitudinal bar unit 50. The first longitudinal bar assembly is disposed at the first side of the bed frame and connected with the first ends of the first and second outer lateral bar units. The second longitudinal bar assembly is disposed at a second side of the bed frame and connected with the second ends of the first and second outer lateral bar units.

Of first longitudinal bar assembly 80, the first end of first longitudinal bar unit 30 is connected with the first end of first outer lateral bar unit 10. The second end of first longitudinal bar unit 30 is rotatably connected with the first end of second longitudinal bar unit 40. The second end of second longitudinal bar unit 40 is rotatably connected with the first end of third longitudinal bar unit 50. The second end of third longitudinal bar unit 50 is rotatably connected with the first end of second outer lateral bar unit 20.

Of second longitudinal bar assembly 90, the first end of first longitudinal bar unit 30 is connected with the second end of second outer lateral bar unit 20. The second end of first longitudinal bar unit 30 is rotatably connected with the first end of second longitudinal bar unit 40. The second end of second longitudinal bar unit 40 is rotatably connected with the first end of third longitudinal bar unit 50. The second end of third longitudinal bar unit 50 is rotatably connected with the second end of first outer lateral bar unit 10.

Figure 3:
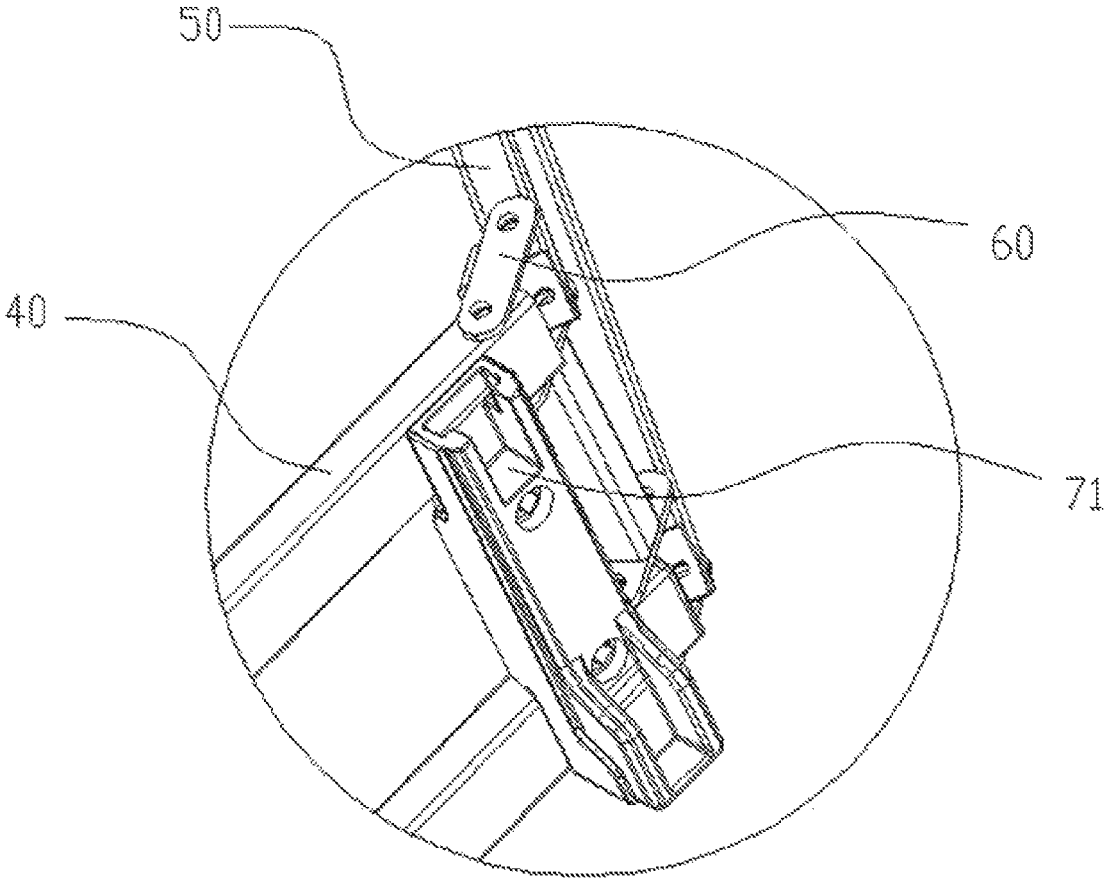
FIG. 3 is an enlarged view taken along circle A of FIG. 2.

The second and third longitudinal bar units can be rotatably connected with each other by any suitable meanings. By way of example, FIGS. 2 and 3 illustrates the second and third longitudinal bar units rotatably connected with each other through connecting piece 60. In some exemplary embodiments, the second end of second longitudinal bar unit 40 and the first end of third longitudinal bar unit 50 each are rotatably connected with connecting piece 60. In an exemplary embodiment, connecting piece 60 includes an upper connecting piece and a lower connecting piece. The upper connecting piece connects upper bars of second longitudinal bar unit 40 and third longitudinal bar unit 50. The lower connecting piece connects lower bars of second longitudinal bar unit 40 and third longitudinal bar unit 50.

During contraction, as illustrated in FIG. 2, the connected portion of the second and third longitudinal bar units of the first longitudinal bar assembly and the connected portion of the second and third longitudinal bar units of the second longitudinal bar assembly retreat into an interior space defined by the collapsible peripheral frame when it is expanded. This reduces the contracted size of the collapsible peripheral frame without being disassembled. As such, it can be easily put to use with no need of cumbersome or complicated installation.

Figure 4:
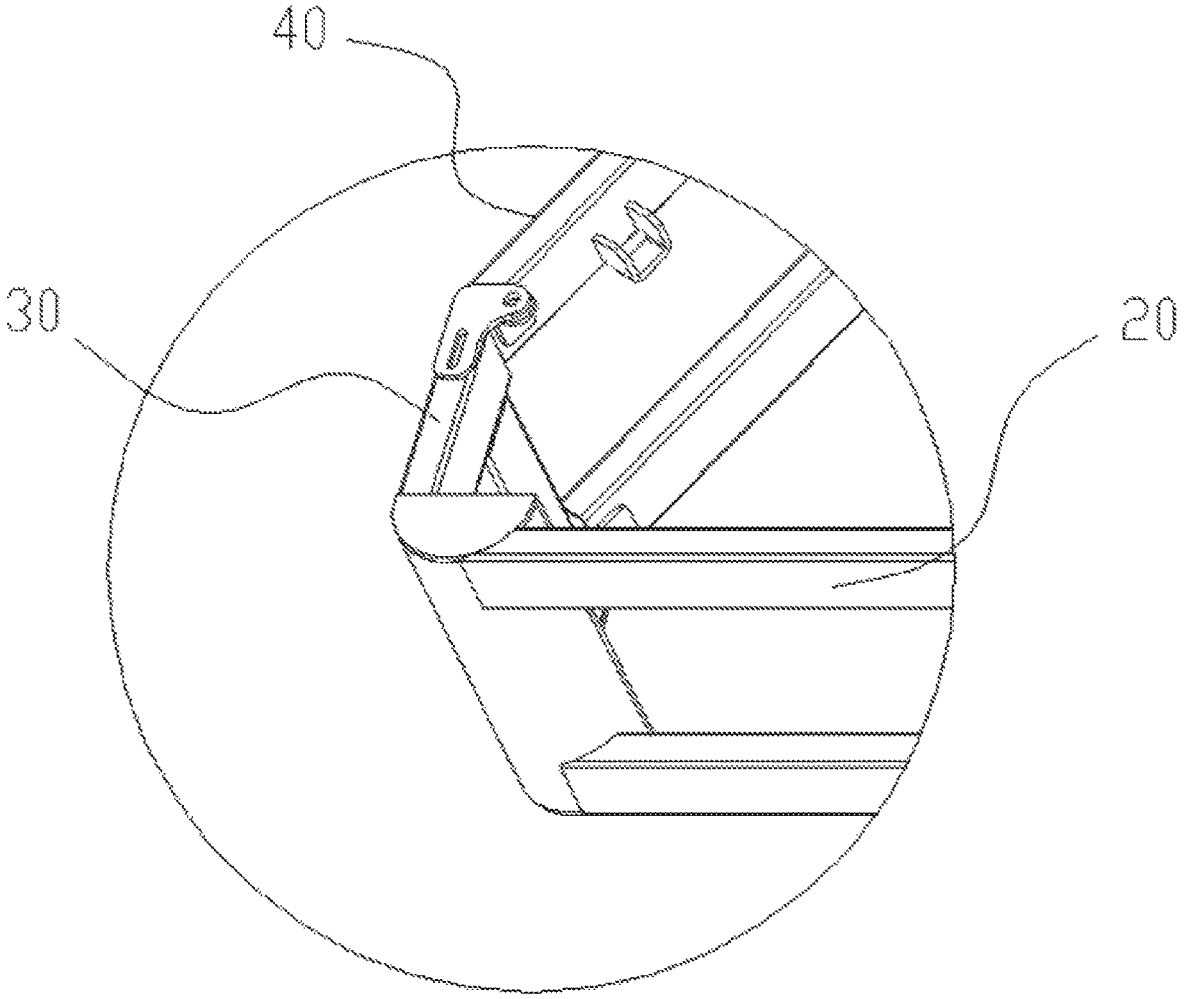
FIG. 4 is an enlarged view taken along circle B of FIG. 2.

Referring to FIGS. 4 and 5, in some exemplary embodiments, of the second longitudinal bar assembly, the first end of first longitudinal bar unit 30 is fixedly connected with the second end of second outer lateral bar unit 20. Similarly, of the first longitudinal bar assembly, the first end of the first longitudinal bar unit is fixedly connected with the first end of the first outer lateral bar unit.

In some exemplary embodiments, of second longitudinal bar assembly 90, first longitudinal bar unit 30 is disposed substantially perpendicular to second outer lateral bar unit 20. Similarly, of the first longitudinal bar assembly, the first longitudinal bar unit is disposed substantially perpendicular to the first outer lateral bar unit. As such, when contracted, the second and third longitudinal bar units are substantially parallel to the first and second outer lateral bar units.

In some exemplary embodiments, as illustrated in FIG. 5, the peripheral frame is configured to allow the second and third longitudinal bar units of the first longitudinal bar assembly to overlap with the second and third longitudinal bar units of the second longitudinal bar assembly when contracted. For instance, in some exemplary embodiments, the length of the combination of the first, second and third longitudinal bar units is greater than that of the first or second outer lateral bar unit, or the length of the third longitudinal bar unit is greater than the half length of the first or second outer lateral bar unit. In some exemplary embodiments, there is no overlapping of the first and second longitudinal bar assemblies. For instance, in some exemplary embodiments, the first or second outer lateral is long (e.g., longer than the second or third longitudinal bar unit, or longer than the combination of the second and third longitudinal bar units) such that the first and second longitudinal bar assemblies do not overlap when folded.

In some exemplary embodiments, the length of the combination of the first and second longitudinal bar units is greater than that of the third longitudinal bar unit, e.g., the sum of the length of the first longitudinal bar unit and the length of the second longitudinal bar unit is greater than the length of the third longitudinal bar unit. As such, the connected portion of the second and third longitudinal bar units of first longitudinal bar assembly 80 is closer to outer lateral bar unit 20, and the connected portion of the second and third longitudinal bar units of second longitudinal bar assembly 90 is closer to first outer lateral bar unit 10. In other words, the connected portion of the second and third longitudinal bar units of the first longitudinal bar assembly and the connected portion of the second and third longitudinal bar units of the second longitudinal bar assembly are offset from each other in the longitudinal direction of the bed frame. The second and third longitudinal bar units can have the same or different configurations such as the same or different structures, lengths or other configuration parameters. In an exemplary embodiment, the second longitudinal bar unit has a length substantially the same as the third longitudinal bar unit.

In some exemplary embodiments, the first longitudinal bar unit is not less than a combined thickness of the second and third longitudinal bar units, e.g., the first longitudinal bar unit has a length that is equal to or greater than the sum of the thickness of the second longitudinal bar unit and the thickness of the third longitudinal bar unit. As such, when contracted, the overlapped portions of the second and third longitudinal bar units of the first and second longitudinal bar assemblies can be disposed tightly side by side. This results in a very compact contracted frame which requires minimal storage space.

A bed frame of the present invention includes a collapsible peripheral frame disclosed herein. In some exemplary embodiments, a bed frame of the present invention includes additional or optional components. For instance, in some exemplary embodiments, a bed frame includes an inner lateral bar unit such as inner lateral bar unit 72 removably connected with the collapsible peripheral frame. The inner lateral bar unit helps to stabilize the bed frame when in use. In an exemplary embodiment, a receptacle such as receptacle 71 is disposed at second longitudinal bar unit 40 adjacent the second end thereof, e.g., adjacent connecting piece 60. Receptacle 71 is configured to removably receive an end of inner lateral bar 72.

Exemplary collapsible peripheral frames of the present invention can contract and expand while the lateral and longitudinal bar units are connected with each other. As such, there is no need to assemble or disassemble these parts, and there is no need to carry tools such as screwdrivers and wrenches. Moreover, the sizes of the collapsible peripheral frames when contracted are reduced significantly. As such, they require less space for shipping, transportation and storage. Further, with the receptacles, the inner lateral bar unit can be easily installed or removed. As such, using a bed frame of the present invention to make a comfortable bed is not time consuming and does not require much effort.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first longitudinal bar unit could be termed a second longitudinal bar unit, and, similarly, a second longitudinal bar unit could be termed a first longitudinal bar unit, without changing the meaning of the description, so long as all occurrences of the "first longitudinal bar unit" are renamed consistently and all occurrences of the "second longitudinal bar unit" are renamed consistently.

What is claimed is:

1. A bed frame, comprising:

a first outer lateral bar unit disposed at a head side of the bed frame;

a second outer lateral bar unit disposed at a foot side of the bed frame;

first, second and third longitudinal bar units disposed at each of first and second sides of the bed frame between the first and second outer lateral bar units; and a receptacle at each of the first and second side of the bed frame;

wherein at the first side of the bed frame:

a first end of the first longitudinal bar unit is connected with a first end of the first outer lateral bar unit;

a second end of the first longitudinal bar unit is rotatably connected with a first end of the second longitudinal bar unit;

a second end of the second longitudinal bar unit is rotatably connected with a first end of the third longitudinal bar unit; and a second end of the third longitudinal bar unit is rotatably connected with a first end of the second outer lateral bar unit;

wherein at the second side of the bed frame:

a first end of the first longitudinal bar unit is connected with a second end of the second outer lateral bar unit;

a second end of the first longitudinal bar unit is rotatably connected with a first end of the second longitudinal bar unit;

a second end of the second longitudinal bar unit is rotatably connected with a first end of the third longitudinal bar unit; and a second end of the third longitudinal bar unit is rotatably connected with a second end of the first outer lateral bar unit;

wherein each of the first, second and third longitudinal bar units comprises an elongated upper bar and an elongated lower bar, the elongated upper and lower bars being separated from each other in a height direction of the bed frame;

wherein at each of the first and second sides of the bed frame:

the elongated upper bars of the first, second and third longitudinal bar units are aligned with each other along a longitudinal direction of the bed frame when the bed frame is expanded;

the elongated lower bars of the first, second and third longitudinal bar units are aligned with each other along the longitudinal direction of the bed frame when the bed frame is expanded; and the receptacle is connected to the upper and lower bars of the second longitudinal bar unit adjacent to the second end thereof, wherein the receptacle comprises an upper slot and a lower slot, the upper slot is configured to removably receive an end of an upper bar of an inner lateral bar unit and the lower slot is configured to removably receive an end of a lower bar of the inner lateral bar unit.

2. The bed frame of claim 1, wherein a combined length of the first and second longitudinal bar units is greater than that of the third longitudinal bar unit.

3. The bed frame of claim 1, wherein the first longitudinal bar unit has a length that is equal to or greater than a combined thickness of the second and third longitudinal bar units.

4. The bed frame of claim 1, wherein at each of the first and second sides of the bed frame, the second and third longitudinal bar units are rotatably connected with each other through a connecting piece, wherein the second end of the second longitudinal bar unit and the first end of the third longitudinal bar unit are rotatably connected with the connecting piece.

5. The bed frame of claim 1, wherein cross-sectionalwise, the upper bars of the first, second and third longitudinal bar units are substantially the same, and the lower bars of the first, second and third longitudinal bar units are substantially the same.

6. A collapsible peripheral frame, comprising:

first and second outer lateral bar units, each comprising a first end and a second end;

a first longitudinal bar assembly disposed at a first side of the peripheral frame and connected with the first ends of the first and second outer lateral bar units; and a second longitudinal bar assembly disposed at a second side of the peripheral frame and connected with the second ends of the first and second outer lateral bar units;

wherein:

each of the first and second longitudinal bar assemblies comprises first, second and third longitudinal bar units;

of the first longitudinal bar assembly:

a first end of the first longitudinal bar unit is connected with the first end of the first outer lateral bar unit;

a second end of the first longitudinal bar unit is rotatably connected with a first end of the second longitudinal bar unit;

a second end of the second longitudinal bar unit is rotatably connected with a first end of the third longitudinal bar unit; and a second end of the third longitudinal bar unit is rotatably connected with the first end of the second outer lateral bar unit;

of the second longitudinal bar assembly:

a first end of the first longitudinal bar unit is connected with the second end of the second outer lateral bar unit;

a second end of the first longitudinal bar unit is rotatably connected with a first end of the second longitudinal bar unit;

a second end of the second longitudinal bar unit is rotatably connected with a first end of the third longitudinal bar unit; and a second end of the third longitudinal bar unit is rotatably connected with the second end of the first outer lateral bar unit, wherein for each of the first and second longitudinal bar assemblies:

each of the first, second and third longitudinal bar units comprises an elongated upper bar and an elongated lower bar separated from the elongated upper bar in a height direction of the peripheral frame, and when the peripheral frame is expanded, the elongated upper bars of the first, second and third longitudinal bar units are aligned with each other along a longitudinal direction of the peripheral frame, and the elongated lower bars of the first, second and third longitudinal bar units are aligned with each other along the longitudinal direction of the peripheral frame.

7. The collapsible peripheral frame of claim 6, wherein:

of the first longitudinal bar assembly, the first end of the first longitudinal bar unit is fixedly connected with the first end of the first outer lateral bar unit; and of the second longitudinal bar assembly, the first end of the first longitudinal bar unit is fixedly connected with the second end of the second outer lateral bar unit.

8. The collapsible peripheral frame of claim 7, wherein:

of the first longitudinal bar assembly, the first longitudinal bar unit is disposed substantially perpendicular to the first outer lateral bar unit; and of the second longitudinal bar assembly, the first longitudinal bar unit is disposed substantially perpendicular to the second outer lateral bar unit.

9. The collapsible peripheral frame of claim 6, wherein a combined length of the first and second longitudinal bar units is greater than that of the third longitudinal bar unit.

10. The collapsible peripheral frame of claim 9, wherein the second longitudinal bar unit has a length that is substantially the same as the third longitudinal bar unit.

11. The collapsible peripheral frame of claim 9, wherein the first longitudinal bar unit has a length that is equal to or greater than a combined thickness of the second and third longitudinal bar units.

12. The collapsible peripheral frame of claim 6, wherein at each of the first and second sides of the bed frame, the second and third longitudinal bar units are rotatably connected with each other through a connecting piece, wherein the second end of the second longitudinal bar unit and the first end of the third longitudinal bar unit are rotatably connected with the connecting piece.

13. The collapsible peripheral frame of claim 6, wherein at each of the first and second sides of the bed frame, a receptacle connected to the upper and lower bars of the second longitudinal bar unit adjacent the second end thereof, the receptacle comprises an upper slot and a lower slot, the upper slot is configured to removably receive an end of an upper bar of an inner lateral bar unit, and the lower slot is configured to removably receive an end of a lower bar of the inner lateral bar unit.

14. A bed frame comprising a collapsible peripheral frame of claim 6.

15. The bed frame of claim 14, wherein:

of the first longitudinal bar assembly, the first longitudinal bar unit is disposed substantially perpendicular to the first outer lateral bar unit, and the first end of the first longitudinal bar unit is fixedly connected with the first end of the first outer lateral bar unit; and of the second longitudinal bar assembly, the first longitudinal bar unit is disposed substantially perpendicular to the second outer lateral bar unit, and the first end of the first longitudinal bar unit is fixedly connected with the second end of the second outer lateral bar unit.

16. The bed frame of claim 14, wherein a combined length of the first and second longitudinal bar units is greater than that of the third longitudinal bar unit.

17. The bed frame of claim 14, wherein the second longitudinal bar unit has a length that is substantially the same as the third longitudinal bar unit.

18. The bed frame of claim 14, wherein the first longitudinal bar unit has a length that is equal to or greater than a combined thickness of the second and third longitudinal bar units.

19. The bed frame of claim 14, wherein at each of the first and second sides of the bed frame, the second and third longitudinal bar units are rotatably connected with each other through a connecting piece, wherein the second end of the second longitudinal bar unit and the first end of the third longitudinal bar unit are rotatably connected with the connecting piece.

20. The bed frame of claim 14, further comprising an inner lateral bar unit having an upper bar and a lower bar, wherein at each of the first and second sides of the bed frame, a receptacle is connected to the upper and lower bars of the second longitudinal bar unit adjacent the second end thereof, the receptacle comprises an upper slot and a lower slot, the upper slot is configured to removably receive an end of the upper bar of the inner lateral bar unit, and the lower slot is configured to removably receive an end of the lower bar of the inner lateral bar.

* * * * *